US007041972B2

(12) United States Patent
Bajic et al.

(10) Patent No.: US 7,041,972 B2
(45) Date of Patent: May 9, 2006

(54) MASS SPECTROMETER

(75) Inventors: Steve Bajic, Sale (GB); Robert Harold Bateman, Knutsford (GB)

(73) Assignee: Waters Investments Limited

( * ) Notice: Subject to any disclaimer, the term of this patent is extended or adjusted under 35 U.S.C. 154(b) by 147 days.

(21) Appl. No.: 10/841,145

(22) Filed: May 7, 2004

(65) Prior Publication Data

US 2005/0035286 A1 Feb. 17, 2005

Related U.S. Application Data

(60) Provisional application No. 60/470,865, filed on May 16, 2003.

(51) Int. Cl.
*H01J 49/10* (2006.01)

(52) U.S. Cl. ..... 250/288; 250/423 R; 250/281; 250/282

(58) Field of Classification Search ..... 250/288, 250/423 R, 281, 282
See application file for complete search history.

(56) References Cited

U.S. PATENT DOCUMENTS 6,462,337 B1 10/2002 Li ..... 250/288
6,737,641 B1 * 5/2004 Kato ..... 250/281

FOREIGN PATENT DOCUMENTS

GB 2 362 259 A 11/2001
JP 55046222 A 3/1980
JP 63187548 A 8/1988

* cited by examiner

*Primary Examiner*—Kiet T. Nguyen
(74) *Attorney, Agent, or Firm*—Anthony J. Janiuk

(57) ABSTRACT

An Atmospheric Pressure Chemical Ionisation ion source is disclosed wherein the current applied to a corona needle 2 is repeatedly varied between two or more settings during a single experimental run or acquisition. Two or more separate sets of mass spectral or mass analysed data are obtained. The ion source in one embodiment comprises a heated tube 1 arranged to discharge gas and analyte into a housing 7 enclosing corona needle 2. The housing 7 comprises a gas outlet port 3 via which analyte ions exit. According to another embodiment the corona needle does not have to be enclosed within a housing.

60 Claims, 9 Drawing Sheets

MASS SPECTROMETER

CROSS REFERENCE TO RELATED APPLICATIONS:

This application claims benefit of U.S. Provisional Application No. U.S. 60/470,865 filed May 16, 2003 and United Kingdom application GB 0310696.9 filed May 9, 2003. The contents of each of the aforementioned applications are hereby expressly incorporated herein by reference in their entirety.

STATEMENT ON FEDERALLY SPONSORED RESEARCH

N/A

FIELD OF THE INVENTION

The present invention relates to a mass spectrometer comprising an ion source. The preferred embodiment relates to a mass spectrometer comprising an Atmospheric Pressure Chemical Ionization ("APCI") ion source.

BACKGROUND OF THE INVENTION

Chemical ionization involves the transfer of charged species from reagent ions to analyte molecules to produce analyte ions that can be subsequently mass analyzed. The charged species most commonly formed in positive ion mode is the adduct between an analyte molecule and positive hydrogen ions ($H^+$).

Chemical ionization conducted at atmospheric pressure is commonly known as Atmospheric Pressure Chemical Ionization ("APCI"). A sample containing analyte material is typically delivered to an Atmospheric Pressure Chemical Ionization ion source as a solution. The solution containing the analyte is then sprayed into a heated tube through which a nebulising gas is also directed. The nebulising gas causes the solution to be finely nebulised into fine droplets which then impact the inner wall of the heated tube and are converted into the gas phase. As the solution is converted into the gas phase the analyte molecules become desolvated. Hot gas comprising mobile phase, microdroplets and desolvated analyte molecules then exit the heated tube and the analyte molecules are then subsequently ionized by chemical ionization with reagent ions. In particular, analyte molecules are ionized by gas phase ion-molecule reactions between reagent ions and the analyte molecules.

Reagent ions which transfer charged species to the analyte molecules to form analyte ions are produced as a result of a corona discharge in the solvent vapour. The corona discharge is generated by applying a high voltage (e.g. 5 kV) to the tip of a sharp corona needle or pin. Analyte molecules are ionized by gas phase ion-molecule reactions in the corona discharge region located between the corona tip and the ion sampling orifice. Analyte ions are therefore generated in the region of the corona discharge since this is where the reagent ions are formed.

A majority of the gas exits the ion source via an exhaust port whilst a small proportion of the gas and analyte ions are drawn through an ion sampling orifice into the vacuum system of the mass spectrometer for subsequent mass analysis.

Conventional APCI ion sources may be considered to have relatively open geometry design. The corona needle is located at the outlet of the heated tube but gas and molecules exiting the heated tube are not constrained to remain in the region of the corona needle. The corona needle is also located adjacent to the ion sampling orifice of the mass spectrometer. The corona needle, heated tube and ion sampling orifice may be enclosed in a large volume enclosure but the large volume enclosure itself has little impact upon the ionisation process.

APCI is in theory applicable to a wide range of analyte polarities. However, highly polar or ionic analytes are more commonly analysed by Electrospray Ionisation ("ESI") ion sources than by APCI ion sources since a problem with conventional APCI ion sources is that when they are used to ionise highly polar analyte molecules the ion signal is observed to decrease as the corona voltage or current is increased. Low to moderately polar analyte samples are more commonly analyzed by APCI ion sources since such analytes exhibit the opposite effect to highly polar analytes i.e. the ion signal intensity increases as the corona voltage or current is increased. Therefore, although conventional APCI ion sources are suited to ionising low to moderately polar analytes they are not best suited to ionising highly polar analytes.

Another particular problem with conventional APCI ion sources is that they are also not particularly suited to analysing a mixture containing both low to moderately polar analytes and also highly polar analytes since the different types of analytes require different corona current settings for optimal ionisation. When faced with the task of using a conventional APCI ion source to ionise a sample comprising a mixture of both low to moderately polar analytes and also highly polar analytes, the conventional approach is either to set the corona current at a compromise setting or more commonly to perform two separate experimental runs or acquisitions. If two separate experimental runs or acquisitions are performed then in the first experimental run or acquisition the corona current may, for example, be optimized for low to moderately polar analyte ions and in the second subsequent experimental run or acquisition the corona current may be optimized for highly polar analyte ions (or vice versa). As will be appreciated such an approach therefore results in a doubling of the total analysis time and also a doubling of the total sample consumption. Both of these increases are problematic. The increase in sample consumption is particularly problematic if only a very small amount of sample is available for analysis (which is often the case).

It is therefore desired to provide an improved ion source. In particular it is desired to provide an APCI ion source which can efficiently analyse a sample comprising both low to moderately polar ions and also highly polar ions.

SUMMARY OF THE INVENTION

According to an aspect of the present invention there is provided an ion source for a mass spectrometer comprising a discharge device, wherein in use the current or voltage applied to the discharge device is switched between a first mode and a second mode at least n times during a single experimental run or acquisition, wherein $n \geqq 1$.

The ion source is preferably an Atmospheric Pressure Ionisation ion source, further preferably an Atmospheric Pressure Chemical Ionisation source.

The discharge device preferably comprises a corona discharge device such as a corona needle or pin.

According to various embodiments n may be 1, 2–10, 10–50, 50–100, 100–200, 200–400, 400–600, 600–800, 800–1000, 1000–2000, 2000–3000, 3000–4000, 4000–5000, 5000–6000, 6000–7000, 7000–8000, 8000–9000, 9000–10000, 10000–15000, 15000–20000, 20000–25000 or >25000.

The discharge device is preferably switched between the first mode and the second mode at least x times per minute, wherein x is preferably 1–10, 10–20, 20–30, 30–40, 40–50, 50–60, 60–70, 70–80, 80–90, 90–100, 100–120, 120–140, 140–160, 160–180, 180–200, 200–250, 250–300, 300–350, 350–400, 400–450, 450–500, 500–600, 600–700, 700–800, 800–900, 900–1000, 1000–2000, 2000–3000, 3000–4000, 4000–5000 or >5000.

When the discharge device is in the first mode a first current or a first voltage is preferably applied to the discharge device. The first current is preferably <0.1 μA, 0.1–0.2 μA, 0.2–0.3 μA, 0.3–0.4 μA, 0.4–0.5 μA, 0.5–0.6 μA, 0.6–0.7 μA, 0.7–0.8 μA, 0.8–0.9 μA, 0.9–1.0 μA or >1 μA. The first voltage is preferably <1 kV, 1–2 kV, 2–3 kV, 3–4 kV, 4–5 kV, 5–6 kV, 6–7 kV, 7–8 kV, 8–9 kV, 9–10 kV or >10 kV.

When the discharge device is in the second mode a second current or a second voltage is preferably applied to the discharge device. The second current is preferably <0.1 μA, 0.1–0.2 μA, 0.2–0.3 μA, 0.3–0.4 μA, 0.4–0.5 μA, 0.5–0.6 μA, 0.6–0.7 μA, 0.7–0.8 μA, 0.8–0.9 μA, 0.9–1.0 μA or >1 μA. The second voltage is preferably <1 kV, 1–2 kV, 2–3 kV, 3–4 kV, 4–5 kV, 5–6 kV, 6–7 kV, 7–8 kV, 8–9 kV, 9–10 kV or >10 kV.

There is preferably an interscan delay between or whilst switching the discharge device from the first mode to the second mode. Preferably, during the interscan delay mass analysed or mass spectral data is either substantially not obtained or if obtained then it is preferably not used to provide a final mass spectrum. The interscan delay is preferably <1 ms, 1–10 ms, 10–20 ms, 20–30 ms, 30–40 ms, 40–50 ms, 50–60 ms, 60–70 ms, 70–80 ms, 80–90 ms, 90–100 ms, 100–150 ms, 150–200 ms, 200–250 ms, 250–300 ms, 300–350 ms, 350–400 ms, 400–450 ms, 450–500 ms, 500–600 ms, 600–700 ms, 700–800 ms, 800–900 ms, 900–1000 ms, 1–2 s, 2–3 s, 3–4 s, 4–5 s, 5–6 s, 6–7 s, 7–8 s, 8–9 s, 9–10 s or >10 s.

The ion source preferably comprises a nebuliser device which discharges, in use, analyte molecules and/or analyte ions towards the discharge device. The nebuliser device is preferably heated in use and a nebulising gas is preferably supplied in use to the nebuliser device.

Preferably, the ion source comprises a spray device for spraying a sample and causing the sample to form droplets. The droplets are preferably arranged to impinge upon a heated tube. A nebulising gas may be supplied in use to the heated tube in order to aid nebulisation of the droplets emitted by the spray device.

A housing may at least partially enclose the discharge device. The heated tube preferably discharges, in use, analyte molecules and/or analyte ions preferably into the housing. The housing preferably comprises a gas exit port. The heated tube is preferably received within or is substantially integral with the housing.

According to an aspect of the present invention there is provided a mass spectrometer comprising an ion source as described above.

The mass spectrometer preferably comprises an ion sampling orifice. Ions in the vicinity of the ion sampling orifice may according to one embodiment be substantially shielded from an electric field generated by the discharge device. Preferably, ions in the vicinity of the ion sampling orifice are substantially shielded from an electric field generated by the discharge device by a housing surrounding at least part of the discharge device.

At least one electrode may optionally be arranged opposite the ion sampling orifice so as to deflect, direct or repel at least some ions towards the ion sampling orifice.

The ion source may be connected, in use, to a gas or liquid chromatograph.

The mass spectrometer preferably further comprises a Time of Flight mass analyser, a quadrupole mass analyser, a Penning mass analyser, a Fourier Transform Ion Cyclotron Resonance ("FTICR") mass analyser, a magnetic sector mass analyser, a 2D or linear quadrupole ion trap or a Paul or 3D quadrupole ion trap.

According to another aspect of the present invention there is provided a method of mass spectrometry comprising:

providing an ion source comprising a discharge device;

switching the current or voltage applied to the discharge device between a first mode and a second mode at least n times during an experimental run or acquisition, wherein $n \geqq 1$; and obtaining mass analysed data in both the first mode and the second mode.

According to an embodiment mass analysed data obtained in the first and second modes may be stitched together or otherwise interleaved in order to provide a composite mass spectrum or mass chromatogram showing the response of a sample when the discharge device is in the first mode and the second mode. According to another embodiment a mass spectrum or mass chromatogram for either the first mode and/or the second mode may be provided.

Preferably, the response of a sample in both the first and second modes may be used to help determine the polarity of the sample. This information may be used to assist in identifying the sample.

The present inventors have considered and have sought to understand the different responses of low to moderately polar analytes and also highly polar analytes when ionised by a conventional APCI ion source. It is believed that when highly polar or ionic analytes are introduced into a conventional Atmospheric Pressure Chemical Ionisation ion source, analyte ions or charged micro-droplets emerge from the outlet of the heated tube and travel towards the corona needle without having interacted with reagent ions i.e. analyte ions are formed without reacting with reagent ions produced by the corona discharge. The precise mechanism involved in the ionization of highly polar or ionic analytes is not, at present, fully understood but is believed to be a thermal ionisation process similar to thermospray.

As the corona needle is maintained at a relatively high positive potential (for positive ion analysis) an electric field is generated in the region of the corona needle. The electric field generated by the corona needle (and also possibly by the space-charge effect due to a high concentration of reagent ions as a result of corona discharge) is believed to retard, deflect and disperse the already positively charged analyte ions or micro-droplets which exit the heated tube. The analyte ions or charged analyte micro-droplets therefore become defocused, deflected or dispersed in the region of the ion sampling orifice. If the voltage or current applied to the corona needle is increased then the positive analyte ions or micro-droplets are merely retarded, deflected and dispersed to an even greater extent and hence even fewer analyte ions will consequently make it to the ion sampling orifice and into the main body of the mass spectrometer. Since fewer ions will pass into the main body of the mass spectrometer for subsequent mass analysis, then the ion signal intensity for highly polar or ionic analytes will be decreased.

As will be discussed in more detail later, it is for the above given reasons that the present inventors believe that the ion signal intensity for highly polar or ionic analytes is optimized when a relatively low current or voltage is applied to the corona needle. In contrast, the ion signal intensity for low to moderately polar analytes is optimized when a relatively high current or voltage is applied to the corona needle. It is believed that when a higher current or voltage is applied to the corona needle of an APCI ion source then a greater number of reagent ions are generated in the region of the corona needle due to the corona discharge process. The increased number of reagent ions interact with the low to moderately polar analyte molecules emerging from the heated tube and generate a higher number of analyte ions. As low to moderately polar analytes are not charged prior to exiting the heated tube, the low to moderately polar analyte molecules are not significantly retarded, deflected or dispersed by the electric field generated by the corona needle (or by space-charge effects due to a high concentration of reagent ions). Accordingly, as the current or voltage applied to the corona needle is increased, analyte molecules will continue to approach the corona discharge region unhindered. A greater number of analyte ions will therefore be formed due to an increase in the number of reagent ions formed which can then interact with the analyte molecules. The resulting analyte ions will pass through the ion sampling orifice for subsequent mass analysis and hence a greater ion signal intensity will be observed.

DESCRIPTION OF THE DRAWINGS

Various embodiments of the present invention will now be described, by way of example only, and with reference to the accompanying drawings in which.

DETAILED DESCRIPTION

Figure 1:
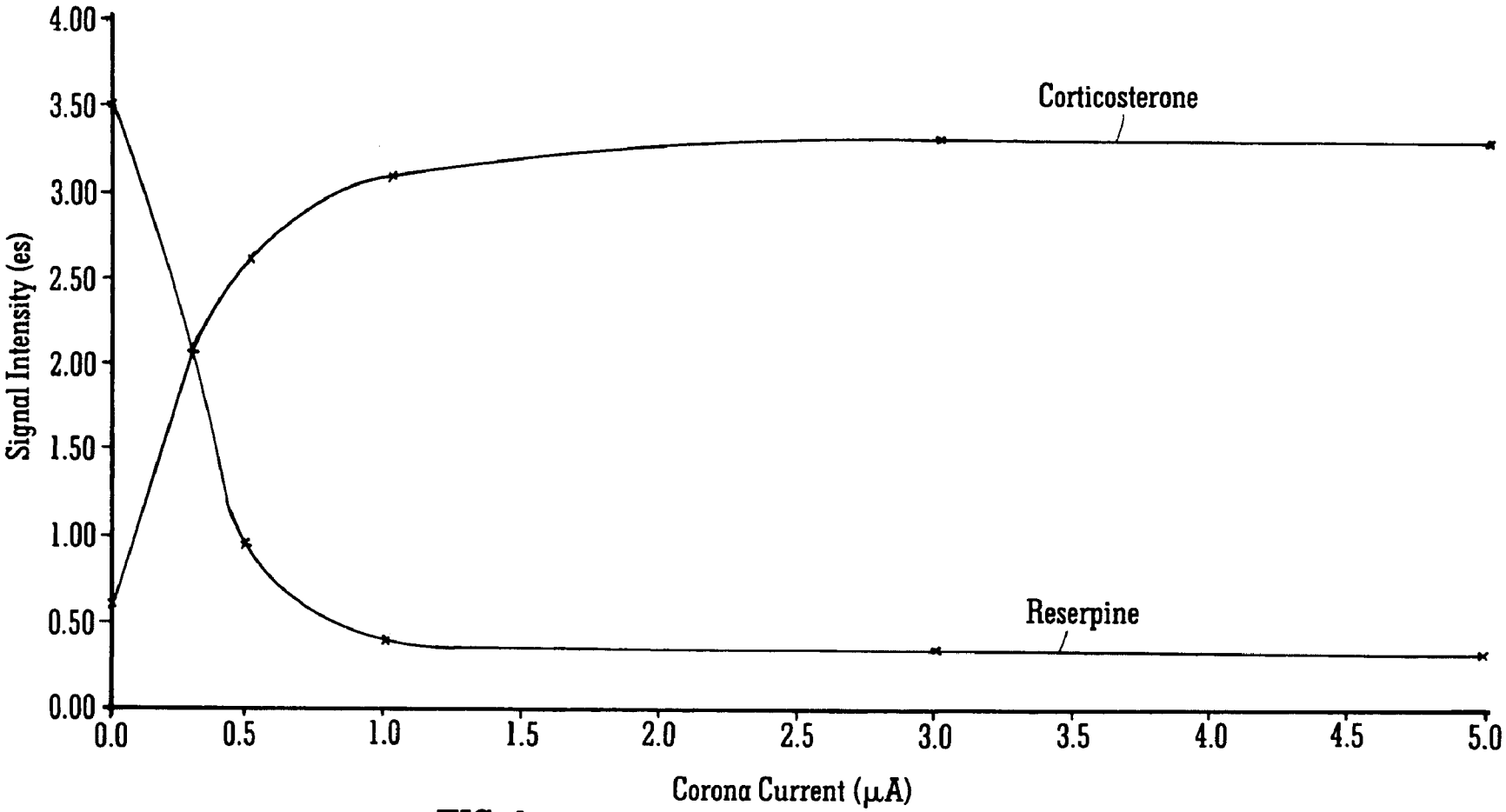
FIG. 1 PRIOR ART
FIG. 1 illustrates how the ion signal intensity for a highly polar sample (Reserpine) and a low to moderately polar sample (Corticosterone) varies as a function of the current applied to a corona needle of a conventional APCI ion source.

Referring to FIG. 1, this figure shows how the ion signal intensity varies as a function of the current applied to a corona needle of a conventional Atmospheric Pressure Chemical Ionisation ("APCI") ion source for two different analytes. As can be seen from FIG. 1, the ion signal intensity for a low to moderately polar sample (i.e. Corticosterone) increases relatively rapidly and then plateaus at a certain point as the current applied to the corona needle is further increased. The initial increase in ion signal intensity is believed to be due to the ion source producing more reagent ions as the current applied to the corona needle is increased. The increased number of reagent ions interact with the analyte molecules emerging from the heated tube and hence more analyte ions are produced. Accordingly, an increased number of analyte ions are then subsequently mass analysed and hence an increase in the ion signal intensity is observed.

It can also be seen from FIG. 1 that increasing the current applied to the corona needle of the ion source has the opposite affect for a highly polar sample (i.e. Reserpine). As the current applied to the corona needle is increased, the ion signal intensity for Reserpine decreases relatively rapidly and then remains at a substantially constant low level. In contrast to low to moderately polar samples it is believed that relatively highly polar analytes such as Reserpine exit the nebuliser probe in an already charged state possibly due to thermal ionisation effects. The already charged analyte ions are therefore then effectively retarded by the electric field resulting from the current applied to the corona needle. The highly polar analyte ions are therefore deflected and dispersed by the electric field generated by the corona needle. Increasing the potential of the corona needle (which may as a consequence increase the current drawn from the corona needle) merely increases the strength of the electric field in the region of the corona needle and hence in the region adjacent to the exit of the heated tube. Therefore, increasing the current applied to the corona needle merely increases the level of retardation, deflection and dispersal of the charged analyte ions which exit the heated tube. As a result as the corona current is increased fewer analyte ions pass through the ion sampling orifice and into the main body of the mass spectrometer for subsequent mass analysis.

In view of the different responses of low to moderately polar analytes and highly polar analytes to the current applied to the corona needle as shown in FIG. 1, the conventional approach when seeking to ionise a mixture containing both low to moderately polar analytes and also highly polar or ionic analytes is either to set the current applied to the corona needle at some compromise level (e.g. 0.25 μA for the example shown in FIG. 1) which results in sub-optimal ionisation or alternatively to perform two separate acquisitions in which a first acquisition is performed at a first corona current setting followed by a second acquisition at a second corona current setting. The conventional approach therefore either results in ion signals which are not maximised (if a single acquisition at a compromise corona current is performed) or alternatively the total analysis time and sample consumption is effectively doubled (if two separate acquisitions at different corona currents are performed).

Figure 2:
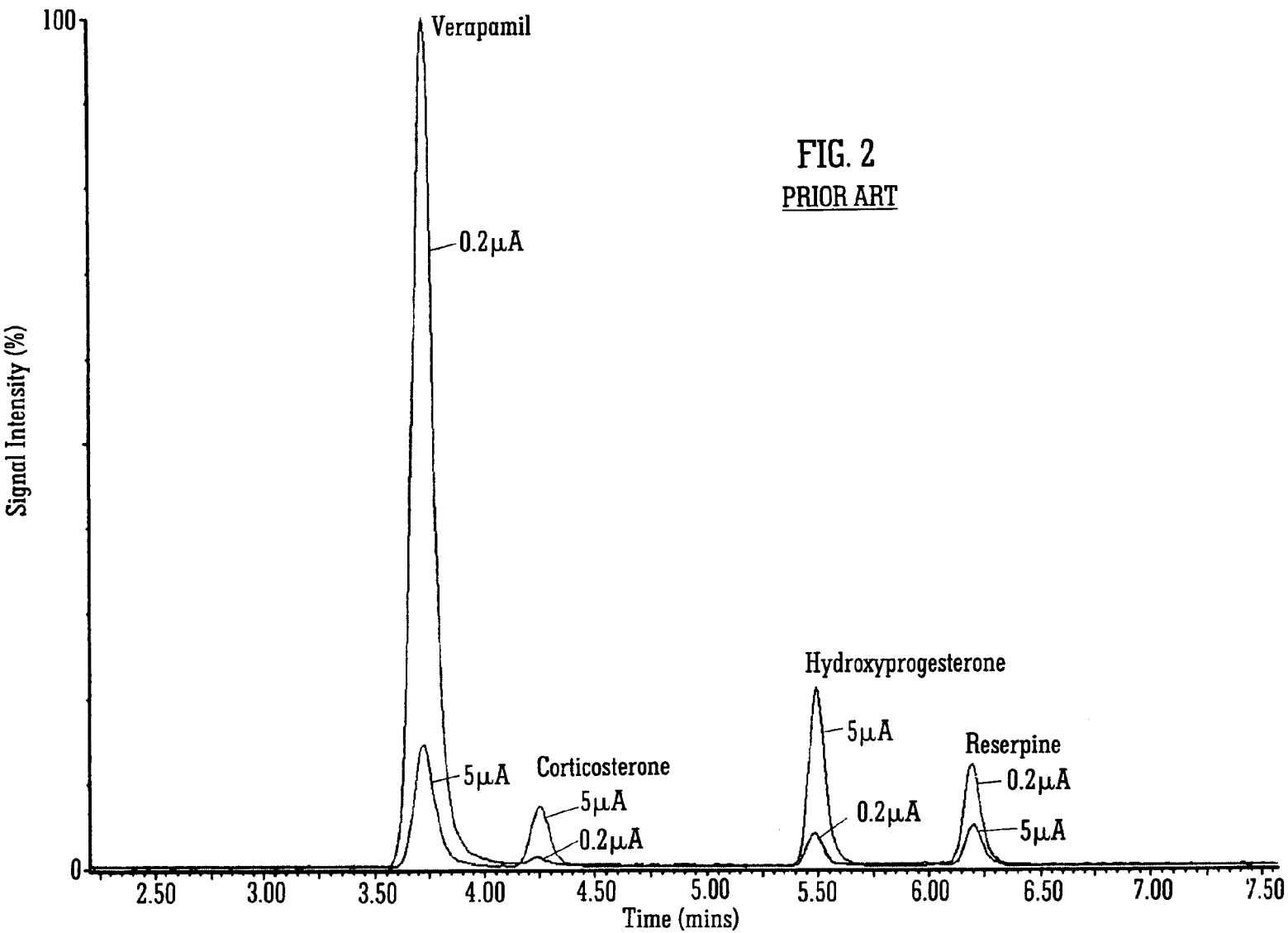
FIG. 2 PRIOR ART
FIG. 2 shows two superimposed ion signals intensities obtained from two separate LC/MS MRM analyses of a sample comprising four different analytes wherein during the first acquisition the corona current was maintained at 0.2 μA and wherein during the second acquisition the corona current was increased to 5 μA.

FIG. 2 shows the results of a four channel Multiple Reaction Monitoring ("MRM") experiment performed using a conventional APCI ion source and a triple quadrupole mass spectrometer. In particular FIG. 2 shows an overlay of the ion signals resulting from two separate acquisitions in which a mixture comprising Verapamil, Corticosterone, Hydroxyprogesterone and Reserpine was analysed using Liquid Chromatography Mass Spectrometry ("LCMS").

As will be understood by those skilled in the art, in a MRM experiment a first mass filter (e.g. quadrupole rod set mass filter) is set to transmit parent ions having a certain (specific) mass to charge ratio. The selected parent ions having a particular mass to charge ratio are then introduced into a collision or fragmentation cell wherein the parent ions are fragmented, in use, into daughter or fragment ions. A second mass filter (e.g. quadrupole rod set mass filter) downstream of the collision or fragmentation cell is then arranged to transmit daughter or fragment ions having a certain (specific) mass to charge ratio.

In this and the following described MRM experiments, Verapamil parent ions having a mass to charge ratio of 455.1 were transmitted by the first mass filter and were fragmented in the collision or fragmentation cell. Daughter or fragment ions having a mass to charge ratio of 165.1 were arranged to be transmitted by the second mass filter. Corticosterone parent ions having a mass to charge ratio of 347.1 were transmitted by the first mass filter and were fragmented in the collision or fragmentation cell. Daughter or fragment ions having a mass to charge ratio of 329.1 were arranged to be transmitted by the second mass filter. Hydroxyprogesterone parent ions having a mass to charge ratio of 331.1 were transmitted by the first mass filter and were fragmented in the collision or fragmentation cell. Daughter or fragment ions having a mass to charge ratio of 109.1 were arranged to be transmitted by the second mass filter. Finally, Reserpine parent ions having a mass to charge ratio of 609.1 were transmitted by the first mass filter and were fragmented in the collision or fragmentation cell. Daughter or fragment ions having a mass to charge ratio of 195.1 were arranged to be transmitted by the second mass filter.

A first experimental run or acquisition was performed over a period of 20 minutes (including column equilibrium) during which time the four analytes eluted within a time of 7 minutes and wherein a current of 0.2 μA was applied to the corona needle. A second experimental run or acquisition was then subsequently performed over another period of 20 minutes (including column equilibrium) again wherein the four analytes eluted within a time of 7 minutes but wherein a current of 5 μA was applied to the corona needle. The analytes in order of elution were Verapamil, Corticosterone, Hydroxyprogesterone followed lastly by Reserpine. Verapamil and Reserpine are highly polar molecules whereas Corticosterone and Hydroxyprogesterone are moderately polar molecules.

It can be seen from FIG. 2 that the difference in the resulting ion signal intensity detected for the two separate experimental runs or acquisitions is relatively large especially for the relatively highly polar analyte Verapamil.

As can also be seen from FIG. 2, as the current applied to the corona needle was increased in the second experimental run or acquisition from 0.2 μA to 5 μA, the ion signal intensity for the relatively highly polar analytes Verapamil and Reserpine significantly decreased whereas the ion signal intensity for the low to moderately polar analytes Corticosterone and Hydroxyprogesterone increased.

In contrast to the conventional approach wherein the current applied to a corona needle remains constant during an experimental run or acquisition, according to the preferred embodiment the current or voltage applied to the corona needle of an ion source according to the preferred embodiment is preferably periodically switched or changed between at least two different values during a single experimental run or acquisition. This enables a sufficiently high ion signal intensity for all of the analytes in a sample to be obtained in a single experimental run or acquisition irrespective of whether the analytes in the sample are low/moderately polar or highly polar. Switching the current or voltage applied to the corona needle between two or more values yields two or more sets of data for the sample during the course of a single experimental run or acquisition. The two or more sets of data also enable information concerning the ionic or polar nature of each analyte in the sample to be ascertained which can be useful in helping to identify the analyte.

Figure 3:
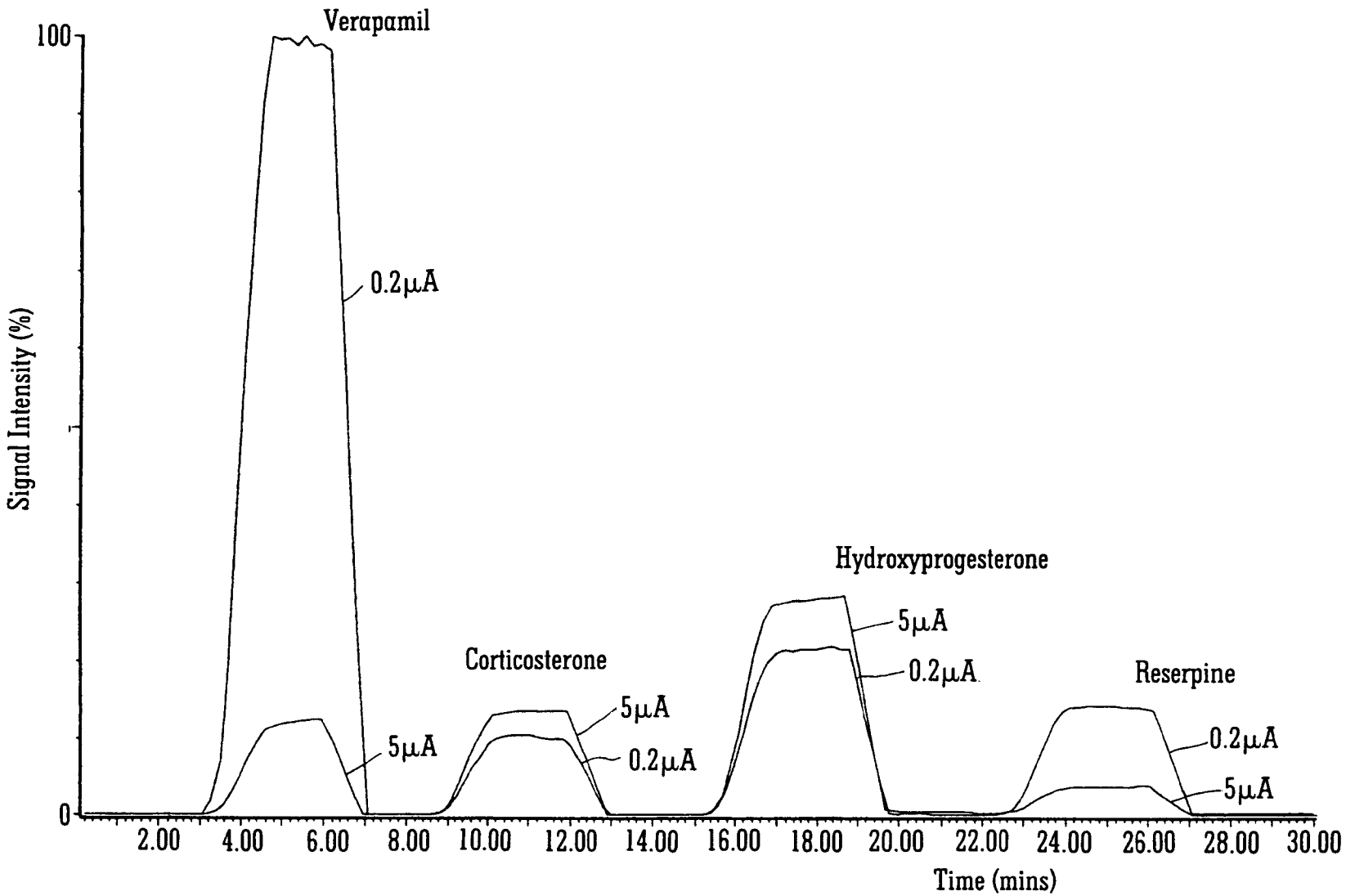
FIG. 3 shows the results from a single acquisition according to an embodiment of the present invention wherein the current applied to the corona needle of an APCI ion source was repeatedly switched between two different values.

FIG. 3 shows the results of a four channel MRM experiment which was intended merely to illustrate the general viability of the preferred method of switching the corona current between two or more different levels during a single experimental run or acquisition.

The MRM experiment was conducted by individually infusing Verapamil, Corticosterone, Hydroxyprogesterone and Reserpine into the mobile phase flow i.e. an LCMS experiment was not performed but rather four separate analyte solutions were introduced, in sequence, from a syringe pump to the continuous flow from a separate pump. The flow was then delivered to an APCI ion source. The corona current was switched between two modes during an acquisition in accordance with an embodiment of the present invention.

Four transition (MS/MS) channels were used, one for each sample. A dwell time of 100 ms was used for each channel i.e. a sample from an individual channel was sampled during a 100 ms window. An interchannel delay of 50 ms was maintained before the next channel was sampled. The four channels were therefore individually sampled over a period of 0.55 s (including interchannel delays) during which time the current supplied to the corona needle was maintained at 0.2 μA. After the four channels had been sampled during which time the corona needle had been maintained at 0.2 μA the current was then switched to 5 μA. The four channels were then individually sampled for a dwell time of 100 ms with a 50 ms interchannel delay as before. In this experiment in order to allow the corona current enough time to increase from 0.2 μA to 5 μA, a 5 s interscan delay was introduced to allow ample time for the corona current to be switched and for the ion source to stablise. A 5 s interscan delay was similarly introduced to allow the corona current to be switched back from 5 μA to 0.2 μA. The data acquisition cycle in this particular example was therefore 11.1 s in duration and the data acquisition cycle was repeated over a 30 minute period.

Figure 4:
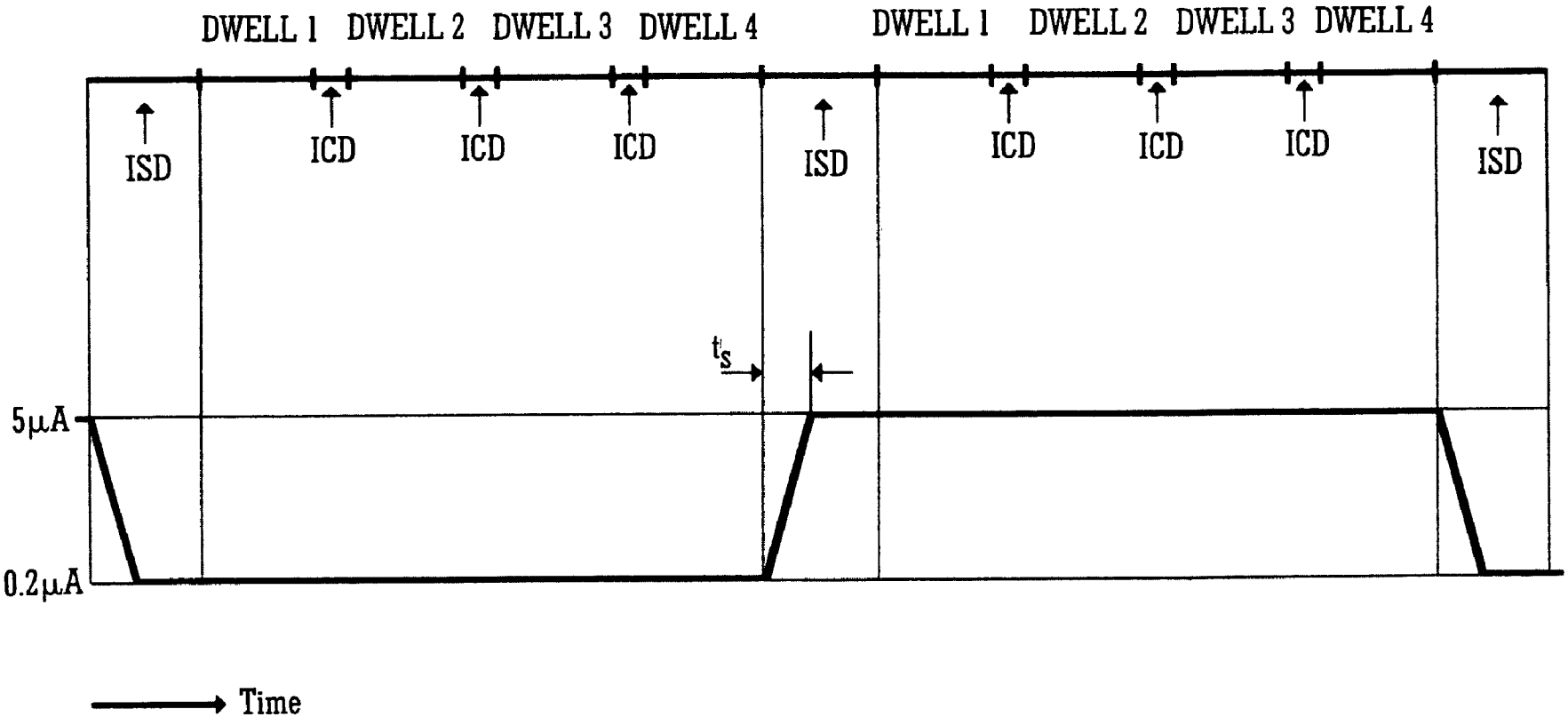
FIG. 4 shows a timing diagram of the current applied to the corona needle of a preferred APCI ion source in a four channel MRM experiment.

FIG. 4 shows a timing diagram for the current applied to the corona needle of an ion source according to an embodiment of the present invention. FIG. 4 shows in more detail how the corona current is changed as a function of time. During an interscan delay ISD the corona current is switched within a time $t_s$. Once the corona current has been switched then at the end of the interscan delay ISD a first channel is sampled during a first dwell time (DWELL 1), followed by an interchannel delay ICD. A second channel is then sampled during a second dwell time (DWELL 2), followed by an interchannel delay ICD. A third channel is then sampled during a third dwell time (DWELL 3), followed by an interchannel delay ICD. A fourth channel is then sampled during a fourth dwell time (DWELL 4). The corona current is then switched during a subsequent interscan delay ISD.

As can be seen from referring back to FIG. 3 the single experiment according to an embodiment of the present invention yielded essentially similar information as that which was obtained according to the conventional approach wherein two separate consecutive experimental runs or acquisitions were performed (see FIG. 2). As with the data shown in FIG. 2, the ion signal intensities detected for the relatively highly polar analytes Verapamil and Reserpine were observed to be highest when a relatively low current (i.e. 0.2 μA) was applied to the corona needle, whereas the ion signal intensities for the low to moderately polar analytes Corticosterone and Hydroxyprogesterone was highest when a relatively high current (i.e. 5 μA) was applied to the corona needle. Thus, a sufficiently high ion signal intensity is able to be obtained for all of the analytes in the sample according to an embodiment of the present invention irrespective of the polarity of the analytes whilst conducting only a single experimental run.

It is recognised that a 5 s interscan delay time as used in the MRM experiment described above in relation to FIG. 3 is generally too slow for applications such as Liquid Chromatography Mass Spectrometry ("LC/MS") applications where an adequate number of data points are required across any eluting peak. Therefore, in order to acquire an adequate number of data points across an eluting peak using Liquid Chromatography Mass Spectrometry ("LC/MS") the interscan delay time (i.e. the time during which the corona current is switched and in which time no data is preferably being recorded and/or used) should ideally be reduced to be as short as possible. According to a preferred embodiment the interscan delay may be ≦200 ms. According to particularly preferred embodiments the interscan delay may be approximately 20–30 ms.

Figure 5:
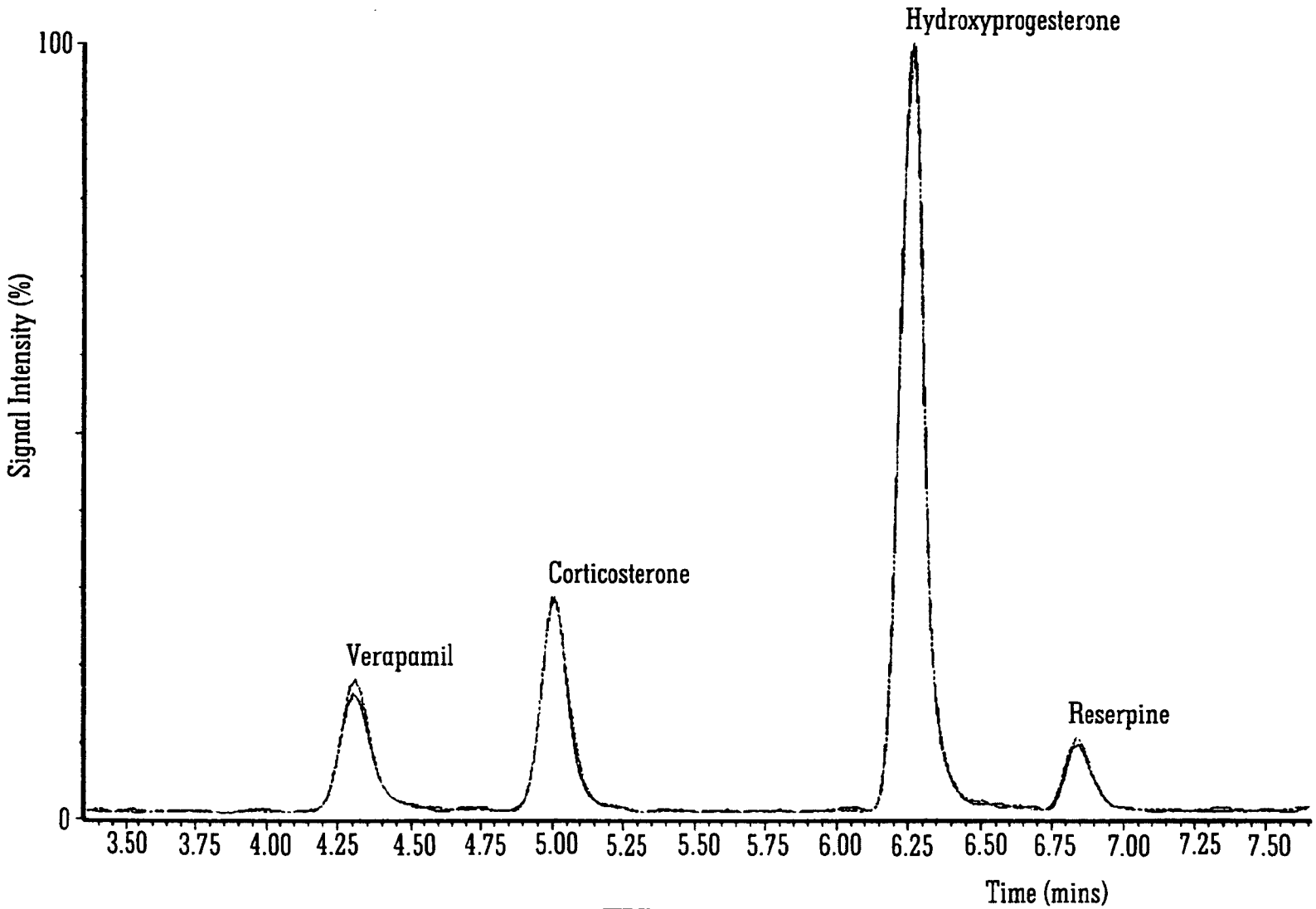
FIG. 5 shows the response obtained when attempting to repeatedly and rapidly switch the corona current applied to the corona needle of a conventional APCI ion source.

FIG. 5 shows the results of attempting to switch the corona current of a conventional APCI ion source whilst performing a LC/MS MRM experiment similar to that as described above with reference to FIG. 2 (or the MRM experiment described above with reference to FIG. 3) but with a significantly reduced interscan delay of only 200 ms (as opposed to 5 s). The dwell time for each channel was kept at 100 ms and the interchannel delay was similarly kept at 50 ms. From FIG. 5 it is apparent that all the previously demonstrated advantages gained from alternating the current applied to the corona needle in accordance with the preferred embodiment have been lost. Furthermore, the ion signal intensities indicate that the ion source is behaving as though it is in a high current mode irrespective of the current applied to the corona needle (i.e. the ion signal intensities are similar to results shown in FIG. 2 for a corona current of 5 μA). It is believed that the power supply of the conventional APCI ion source used to obtain the data shown in FIG. 5 was unable to respond fast enough to being switched so rapidly. It is believed that current conventional APCI ion sources are not therefore able to be operated in a manner according to the preferred embodiment.

Figure 6:
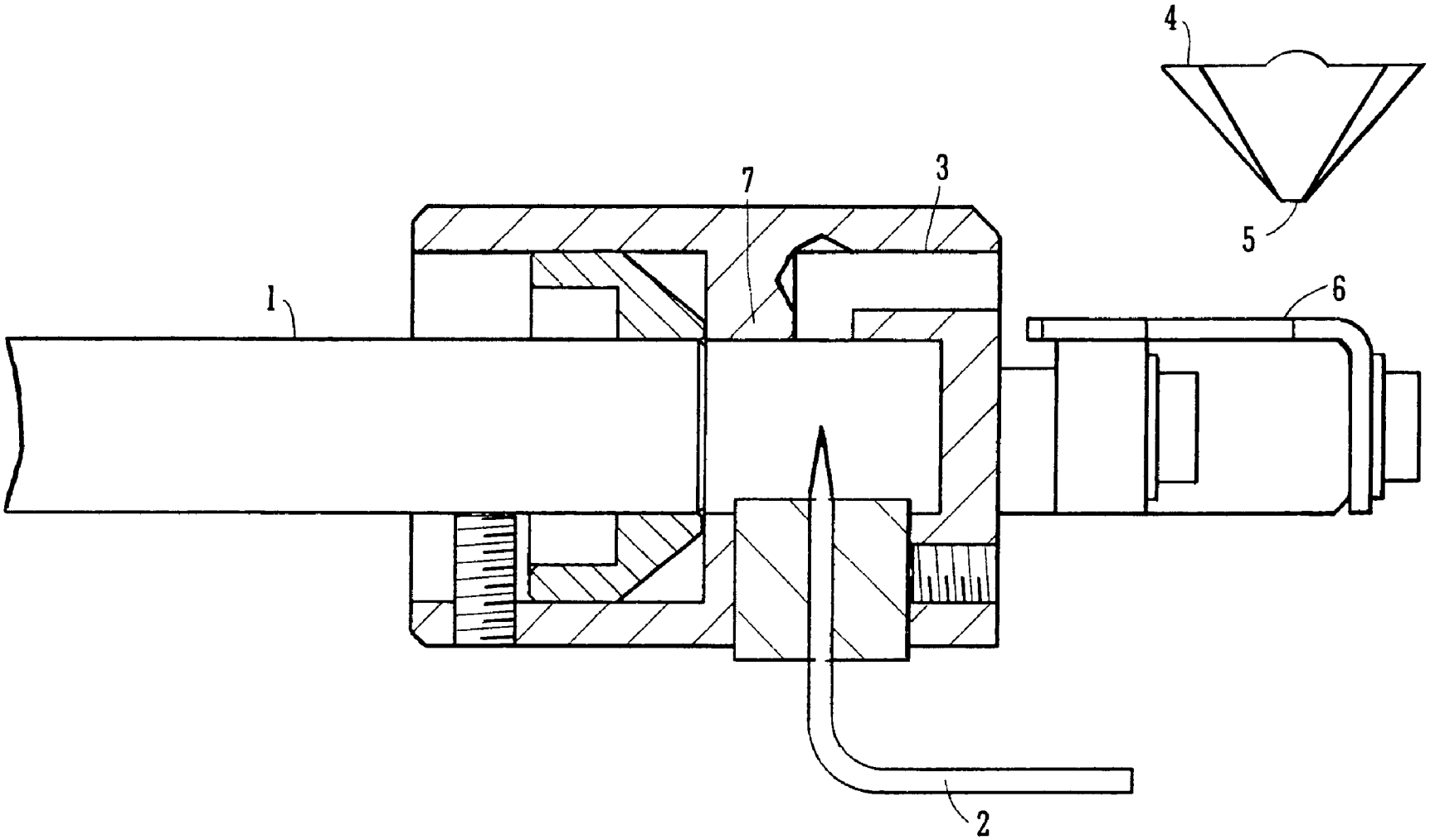
FIG. 6 shows an APCI ion source according to an embodiment of the present invention wherein the corona needle is located within a housing.

FIG. 6 shows an Atmospheric Pressure Chemical Ionisation ion source according to an embodiment of the present invention. The ion source comprises a tube 1 which is preferably heated and a corona needle or pin 2. The corona needle or pin 2 is preferably located in a relatively small volume enclosure or housing 7 which also receives the exit of the heated tube 1. The housing 7 has a gas outlet channel 3 preferably arranged opposite the corona needle or pin 2. The housing 7 preferably directly encloses the corona pin or needle 2 in contrast to conventional open geometry APCI ion sources. Once analyte ions are formed within the housing 7 they then preferably exit via the gas outlet channel 3 and move generally towards an ion sampling orifice 5 of a mass spectrometer. At least some ions are preferably drawn through the ion sampling cone 4 of a mass spectrometer by a flow of gas. In addition, a pusher electrode 6 may be provided wherein a voltage applied to the pusher electrode 6 creates an electric field which assists in pushing or drawing ions through the ion sampling cone 4. The pusher electrode 6 is preferably arranged opposite an ion sampling orifice 5 of the ion sampling cone 4.

Liquid sample from a chromatography system preferably enters the heated tube 1 and is preferably nebulised into droplets by a high velocity stream of gas such as, for example, nitrogen. The resulting droplets preferably comprise mobile phase solvents and analytes. The mobile phase solvents and analytes are preferably heated in the heated tube 1 and are converted into the gas phase.

In contrast to a conventional open geometry ion source, the gas flow which exits the heated tube 1 according to the embodiment shown in FIG. 6 is not free to simply pass directly to the region around the ion sampling orifice 5. Instead, the gas flow exiting the heated tube 1 is constrained within the housing 7 which essentially forms a restricted flow region in the immediate vicinity of the corona needle or pin 2. The gas flow may be expected to be relatively turbulent in the restricted flow region within the housing 7 which is the region where ion-molecule reactions preferably occur between mobile phase reagent ions and analyte molecules. When a current is applied to the corona needle or pin 2 reagent ions are generated in the vicinity of the corona needle or pin 2 due to corona discharge. These reagent ions then interact with analyte molecules exiting the heated tube 1 and transfer charged species to the analyte molecules to form analyte ions.

The analyte ions which are formed within the ion source together with gas then exit the ion source via the gas outlet channel 3. The ions and gas preferably exit the gas outlet channel 3 and expand into a region immediately adjacent to the ion sampling orifice 5. It is believed that reagent ions formed in the vicinity of the corona needle or pin 2 in the enclosed space at the exit of the heated tube 1 are advantageously relatively quickly displaced from the flow path of incoming analyte material by the relatively high gas flow. This may decrease the detrimental effect which a high concentration of reagent ions has on the transmission of analyte ions of highly polar analyte material.

In this embodiment the gas and ions exiting the ion source via the outlet channel 3 flow towards the ion sampling orifice 5 of a mass spectrometer. Ions are preferably drawn into the mass spectrometer by gas flow. In addition a pusher electrode 6 may optionally be arranged substantially opposite the ion sampling orifice 5 in order to provide, in use, an electric field preferably at right angles to the general flow of ions and gas exiting the outlet channel 3. The electric field preferably deflects at least some of the ions into and through the ion sampling orifice 5 of the ion sampling cone 4 and hence increases the ion transmission efficiency into the mass spectrometer. Downstream of the ion sampling orifice 5 gas enters an initial vacuum stage of the mass spectrometer and is preferably allowed to expand into the volume of an outer source enclosure which contains an exhaust port. The ion generation and transmission process described above which occurs in the ion source preferably occurs at, or close to, atmospheric pressure.

Figure 7:
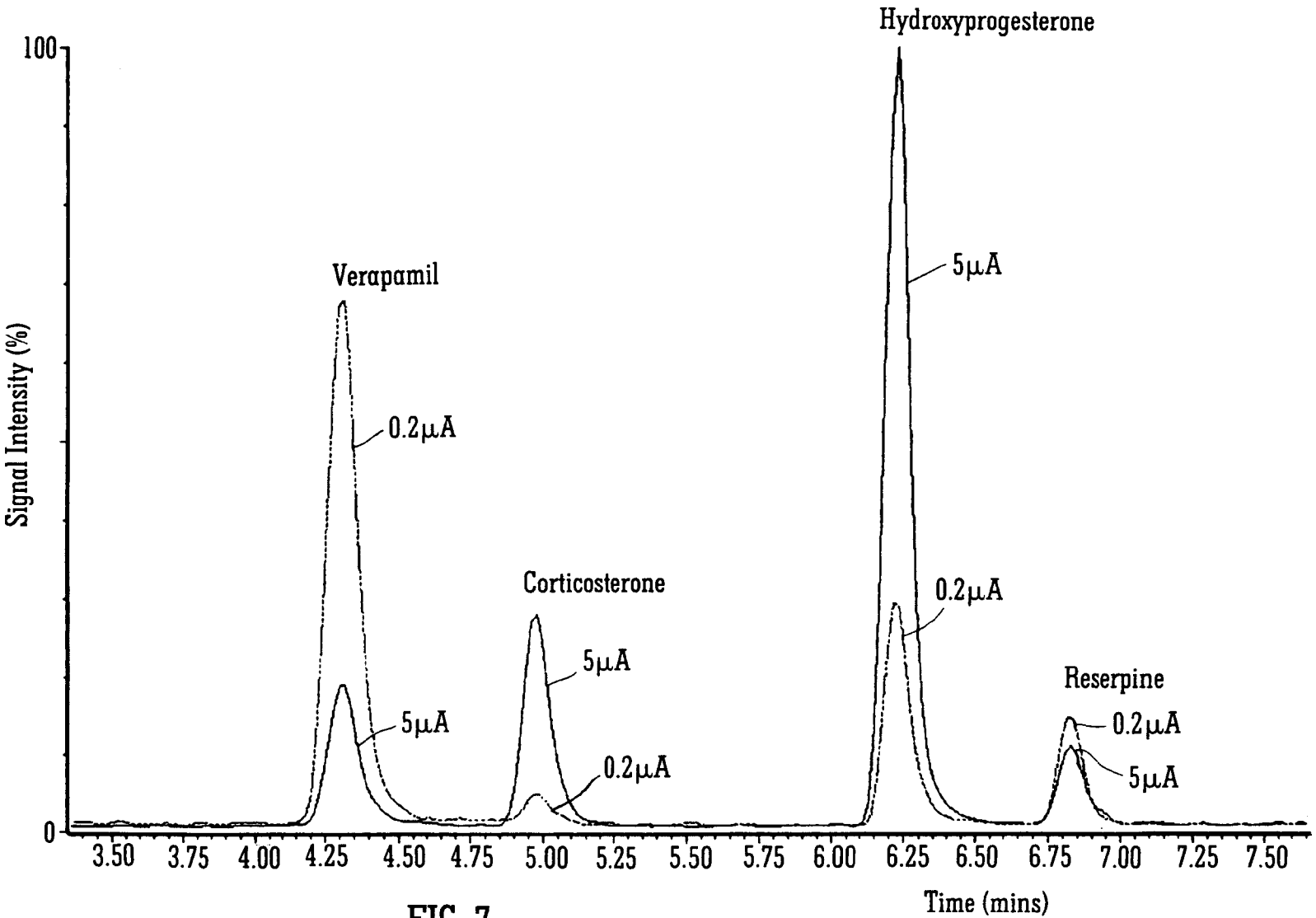
FIG. 7 shows the ion signal intensity for the analysis of a sample during a single acquisition using an ion source as shown in FIG. 6 wherein the current applied to the corona needle was repeatedly switched between two different values.

FIG. 7 shows the ion signal intensity obtained by repeating the LC/MS MRM experiment described above in relation to FIG. 5 but now using an ion source according to the embodiment shown in FIG. 6 wherein the corona pin or needle 2 is enclosed in a housing 7. The corona current was alternately switched between 0.2 μA and 5 μA. An interscan delay of 200 ms, a dwell time of 100 ms and an interchannel delay of 50 ms were used. When this experiment was performed using a conventional APCI ion source the results as shown in FIG. 5 indicate that an interscan delay of 200 ms was too short for the conventional APCI ion source to respond to. However, it is apparent from comparing FIGS. 5 and 7 that in contrast to a conventional ion source, when the current applied to the corona needle or pin 2 of the ion source shown in FIG. 6 was alternated between two different values at a relatively fast rate then the maximum ion signal intensity detected for the relatively highly polar analytes Verapamil and Reserpine increased appreciably when the corona current was low (e.g. 0.2 μA). An analysis of the selected ion chromatographs for each of the analytes indicates a maximum signal enhancement of approximately 350% for Verapamil and approximately 50% for Reserpine when compared to the ion signal intensity obtained using a conventional open geometry ion source as shown in FIG. 5. The maximum ion signal responses for the low to moderately polar analytes Corticosterone and Hydroxyprogesterone were substantially the same as using a convention APCI ion source i.e. no loss of signal for low to moderately polar analytes was observed.

It is apparent that the ion source as shown in FIG. 6 has a significantly faster response time to changes in current applied to the corona needle or pin 2 than a conventional ion source. The ion source shown in FIG. 6 enables the ion signal intensity for both relatively high and also low to moderately polar analytes to be optimised in a single acquisition whilst having a fast (i.e. short) interscan delay which advantageously allows the ion source to be used for LC/MS applications.

Figure 8:
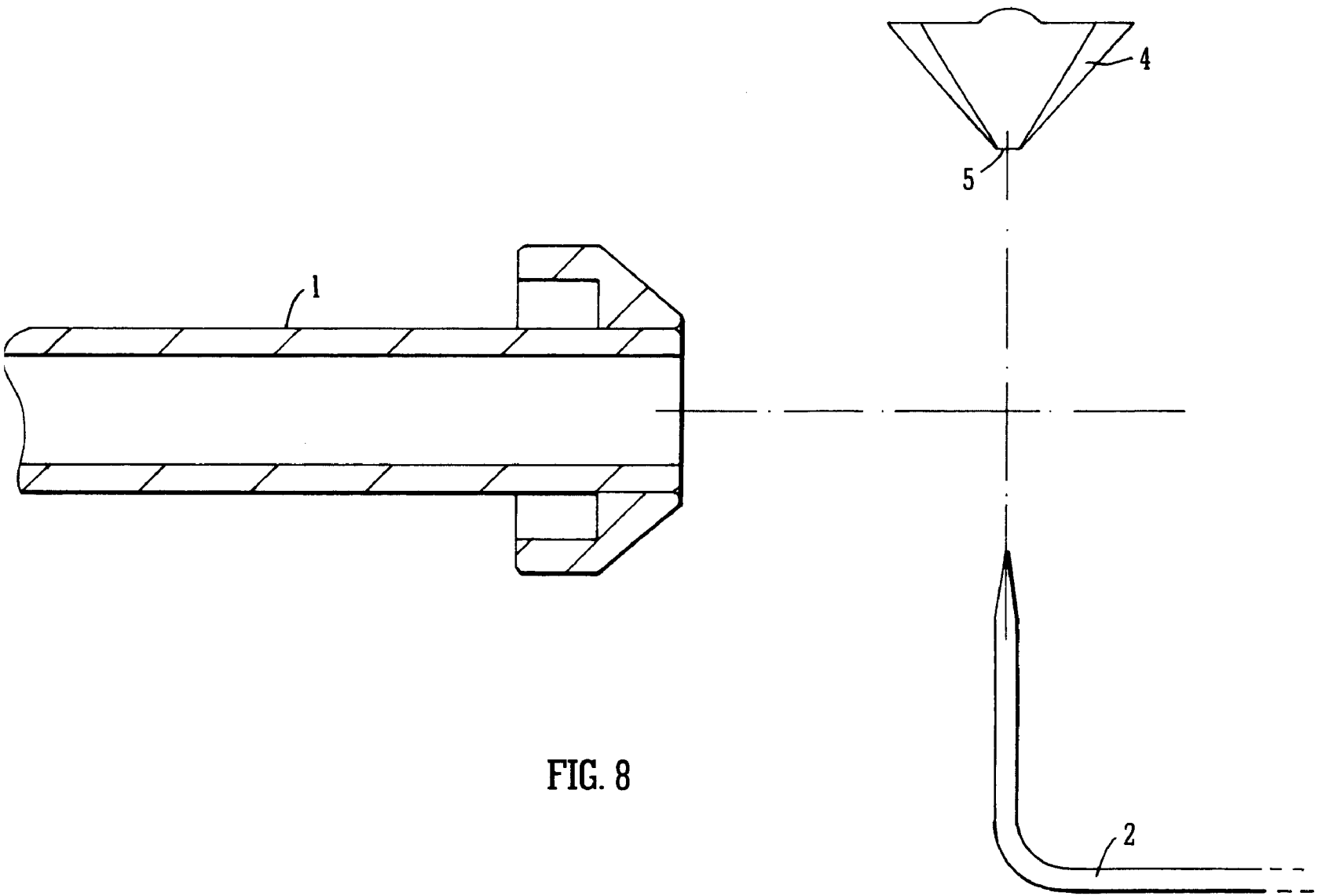
FIG. 8 shows an APCI ion source according to another embodiment of the present invention wherein the corona needle is located opposite the sampling orifice of a mass spectrometer but is not enclosed within a separate housing.

FIG. 8 shows another embodiment wherein the corona needle or pin 2 was not directly enclosed within a housing. A new fast switching current supply was preferably used in order to switch the current supplied to the corona needle or pin 2 at a suitably fast level.

Figure 9:
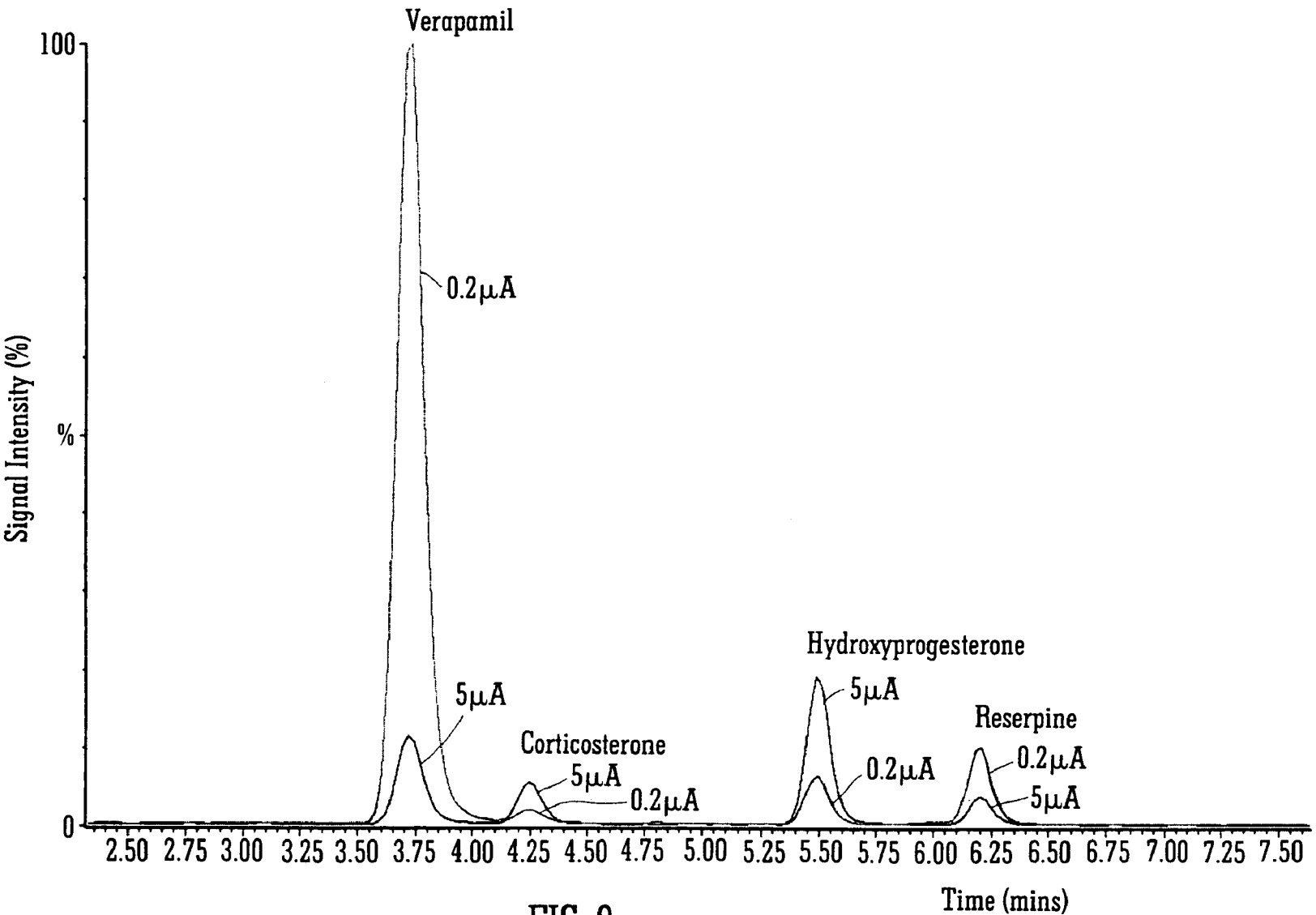
FIG. 9 shows the ion signal intensity for the analysis of a sample during a single acquisition using the ion source as shown in FIG. 8 wherein the current applied to the corona needle was repeatedly switched between two different values.

FIG. 9 shows the ion signal intensity obtained by repeating the LC/MS MRM experiment described above with reference to FIG. 5 using an ion source as shown in FIG. 8 and wherein a fast switching corona current power supply was used. The corona current was alternately switched between 0.2 μA and 5 μA. An interscan delay of 200 ms, a dwell time of 100 ms and an interchannel delay of 50 ms were used. When the current applied to the corona needle or pin 2 of the ion source shown in FIG. 8 was alternated between two different values at a relatively fast rate, the maximum ion signal intensity detected for the relatively highly polar analytes Verapamil and Reserpine significantly increased when the corona current was switched from high (e.g. 5 μA) to low (e.g. 0.2 μA). FIG. 9 indicates that substantially the same performance as that shown in FIG. 2 was obtained but advantageously only a single experimental run or acquisition was required.

The ion source shown in FIG. 8 therefore enables the ion signal intensity for both relatively high and low/moderately polar analytes to be optimised in a single acquisition whilst having a fast (i.e. short) interscan delay which is generally desirable for LC/MS applications.

In contrast to conventional ion sources, sample type information such as analyte polarity and optimized detection of all analyte types in a single Liquid Chromatography Mass Spectral ("LC/MS") analysis can be obtained using an ion source as shown in either FIG. 6 or 8 and operated according to the preferred embodiment. Furthermore, data acquisition with a low sample consumption and short analysis time is achieved.

According to a particularly preferred embodiment the current applied to the corona needle or pin 2 can be switched on a time scale of approximately 20 ms (i.e. $t_s$ as shown in FIG. 4 is approximately 20 ms). Accordingly, the interscan delay can be further reduced from 200 ms to e.g. 25–30 ms. It is also contemplated that the corona current could be switched on an even faster timescale (e.g. <10 ms) using very fast current switching supplies.

Although the preferred embodiment has been described above in relation to switching the corona current between just two current or voltage levels it is also contemplated that according to less preferred embodiments the corona current or voltage may be switched between three, four, five, six, seven, eight, nine, ten or more than ten different levels during an experimental run or acquisition.

Although the present invention has been described with reference to preferred embodiments, it will be understood by those skilled in the art that various changes in form and detail may be made without departing from the scope of the invention as set forth in the accompanying claims.

The invention claimed is:

1. An ion source for a mass spectrometer comprising a discharge device, wherein in use the current or voltage applied to said discharge device is switched between a first mode and a second mode at least n times during a single experimental run or acquisition, wherein $n \geqq 1$.

2. An ion source as claimed in claim 1, wherein said ion source comprises an Atmospheric Pressure Ionisation ion source.

3. An ion source as claimed in claim 1, wherein said ion source comprises an Atmospheric Pressure Chemical Ionisation source.

4. An ion source as claimed in claim 1, wherein said discharge device comprises a corona discharge device.

5. An ion source as claimed in claim 4, wherein said corona discharge device comprises a corona needle or pin.

6. An ion source as claimed in claim 1, wherein n is selected from the group consisting of: (i) 1; (ii) 2–10; (iii) 10–50; (iv) 50–100; (v) 100–200; (vi) 200–400; (vii) 400–600; (viii) 600–800; (ix) 800–1000; (x) 1000–2000; (xi) 2000–3000; (xii) 3000–4000; (xiii) 4000–5000; (xiv) 5000–6000; (xv) 6000–7000; (xvi) 7000–8000; (xvii) 8000–9000; (xviii) 9000–10000; (xix) 10000–15000; (xx) 15000–20000; (xxi) 20000–25000; and (xxii) >25000.

7. An ion source as claimed in claim 1, wherein said discharge device is switched between said first mode and said second mode at least x times per minute.

8. An ion source as claimed in claim 7, wherein x is selected from the group consisting of: (i) 1–10; (ii) 10–20; (iii) 20–30; (iv) 30–40; (v) 40–50; (vi) 50–60; (vii) 60–70; (viii) 70–80; (ix) 80–90; (x) 90–100; (xi) 100–120; (xii) 120–140; (xiii) 140–160; (xiv) 160–180; (xv) 180–200; (xvi) 200–250; (xvii) 250–300; (xviii) 300–350; (xix) 350–400; (xx) 400–450; (xxi) 450–500; (xxii) 500–600; (xxiii) 600–700; (xxiv) 700–800; (xxv) 800–900; (xxvi) 900–1000; (xxvii) 1000–2000; (xxviii) 2000–3000; (xxix) 3000–4000; (xxx) 4000–5000; and (xxxi) >5000.

9. An ion source as claimed in claim 1, wherein when said discharge device is in said first mode a first current or a first voltage is applied to said discharge device.

10. An ion source as claimed in claim 9, wherein said first current is selected from the group consisting of: (i) <0.1 μA; (ii) 0.1–0.2 μA; (iii) 0.2–0.3 μA; (iv) 0.3–0.4 μA; (v) 0.4–0.5 μA; (vi) 0.5–0.6 μA; (vii) 0.6–0.7 μA; (viii) 0.7–0.8 μA; (ix) 0.8–0.9 μA; (x) 0.9–1.0 μA; and (xi) >1 μA.

11. An ion source as claimed in claim 9, wherein said first voltage is selected from the group consisting of: (i) <1 kV; (ii) 1–2 kV; (iii) 2–3 kV; (iv) 3–4 kV; (v) 4–5 kV; (vi) 5–6 kV; (vii) 6–7 kV; (viii) 7–8 kV; (ix) 8–9 kV; (x) 9–10 kV; and (xi) >10 kV.

12. An ion source as claimed in claim 1, wherein when said discharge device is in said second mode a second current or a second voltage is applied to said discharge device.

13. An ion source as claimed in claim 12, wherein said second current is selected from the group consisting of: (i) <0.1 μA; (ii) 0.1–0.2 μA; (iii) 0.2–0.3 μA; (iv) 0.3–0.4 μA; (v) 0.4–0.5 μA; (vi) 0.5–0.6 μA; (vii) 0.6–0.7 μA; (viii) 0.7–0.8 μA; (ix) 0.8–0.9 μA; (x) 0.9–1.0 μA; and (xi) >1 μA.

14. An ion source as claimed in claim 12, wherein said second voltage is selected from the group consisting of: (i) <1 kV; (ii) 1–2 kV; (iii) 2–3 kV; (iv) 3–4 kV; (v) 4–5 kV; (vi) 5–6 kV; (vii) 6–7 kV; (viii) 7–8 kV; (ix) 8–9 kV; (x) 9–10 kV; and (xi) >10 kV.

15. An ion source as claimed in claim 1, wherein there is an interscan delay between or whilst switching said discharge device from said first mode to said second mode during which time mass analysed data is either substantially not obtained or is not substantially used to provide at least one final mass spectrum.

16. An ion source as claimed in claim 15, wherein said interscan delay is selected from the group consisting of: (i) <1 ms; (ii) 1–10 ms; (iii) 10–20 ms; (iv) 20–30 ms; (v) 30–40 ms; (vi) 40–50 ms; (vii) 50–60 ms; (viii) 60–70 ms; (ix) 70–80 ms; (x) 80–90 ms; (xi) 90–100 ms; (xii) 100–150 ms; (xiii) 150–200 ms; (xiv) 200–250 ms; (xv) 250–300 ms; (xvi) 300–350 ms; (xvii) 350–400 ms; (xviii) 400–450 ms; (xix) 450–500 ms; (xx) 500–600 ms; (xxi) 600–700 ms; (xxii) 700–800 ms; (xxiii) 800–900 ms; (xxiv) 900–1000 ms; (xxv) 1–2 s; (xxvi) 2–3 s; (xxvii) 3–4 s; (xxviii) 4–5 s; (xxix) 5–6 s; (xxx) 6–7 s; (xxxi) 7–8 s; (xxxii) 8–9 s; (xxxiii) 9–10 s; and (xxxiv) >10 s.

17. An ion source as claimed in claim 1, further comprising a spray device for spraying a sample and causing said sample to form droplets.

18. An ion source as claimed in claim 17, further comprising a heated tube upon which said droplets impinge.

19. An ion source as claimed in claim 18, further comprising a housing at least partially enclosing said discharge device, wherein said heated tube discharges, in use, analyte molecules and/or analyte ions into said housing.

20. An ion source as claimed in claim 19, wherein said housing further comprises a gas exit port.

21. An ion source as claimed in claim 19, wherein said heated tube is received within or is substantially integral with said housing.

22. An ion source as claimed in claim 17, wherein a nebulising gas is supplied in use to nebulise said droplets.

23. A mass spectrometer comprising an ion source as claimed in claim 1.

24. A mass spectrometer as claimed in claim 23, further comprising an ion sampling orifice.

25. A mass spectrometer as claimed in claim 24, wherein ions in the vicinity of said ion sampling orifice are substantially shielded from an electric field generated by said discharge device.

26. A mass spectrometer as claimed in claim 24, wherein ions in the vicinity of said ion sampling orifice are substantially shielded from an electric field generated by said discharge device by a housing surrounding at least part of said discharge device.

27. A mass spectrometer as claimed in claim 24, further comprising at least one electrode arranged opposite said ion sampling orifice so as to deflect, direct or repel at least some ions towards said ion sampling orifice.

28. A mass spectrometer as claimed in claim 23, wherein said ion source is connected, in use, to a gas chromatograph.

29. A mass spectrometer as claimed in claim 23, wherein said ion source is connected, in use, to a liquid chromatograph.

30. A mass spectrometer as claimed in claim 23, further comprising a mass analyser selected from the group consisting of: (i) a Time of Flight mass analyser; (ii) a quadrupole mass analyser; (iii) a Penning mass analyser; (iv) a Fourier Transform Ion Cyclotron Resonance ("FTICR") mass analyser; (v) a 2D or linear quadrupole ion trap; (vi) a Paul or 3D quadrupole ion trap; and (vii) a magnetic sector mass analyser.

31. A method of mass spectrometry comprising:

providing an ion source comprising a discharge device;

switching the current or voltage applied to said discharge device between a first mode and a second mode at least n times during an experimental run or acquisition, wherein $n \geqq 1$; and obtaining mass analysed data in both said first mode and said second mode.

32. A method as claimed in claim 31, wherein said ion source comprises an Atmospheric Pressure Ionisation ion source.

33. A method as claimed in claim 31, wherein said ion source comprises an Atmospheric Pressure Chemical Ionisation source.

34. A method as claimed in claim 31, wherein said discharge device comprises a corona discharge device.

35. A method as claimed in claim 34, wherein said corona discharge device comprises a corona needle or pin.

36. A method as claimed in claim 31, wherein n is selected from the group consisting of: (i) 1; (ii) 2–10; (iii) 10–50; (iv) 50–100; (v) 100–200; (vi) 200–400; (vii) 400–600; (viii) 600–800; (ix) 800–1000; (x) 1000–2000; (xi) 2000–3000; (xii) 3000–4000; (xiii) 4000–5000; (xiv) 5000–6000; (xv) 6000–7000; (xvi) 7000–8000; (xvii) 8000–9000; (xviii) 9000–10000; (xix) 10000–15000; (xx) 15000–20000; (xxi) 20000–25000; and (xxii) >25000.

37. A method as claimed in claim 31, further comprising switching said discharge device between said first mode and said second mode at least x times per minute.

38. A method as claimed in claim 37, wherein x is selected from the group consisting of: (i) 1–10; (ii) 10–20; (iii) 20–30; (iv) 30–40; (v) 40–50; (vi) 50–60; (vii) 60–70; (viii) 70–80; (ix) 80–90; (x) 90–100; (xi) 100–120; (xii) 120–140; (xiii) 140–160; (xiv) 160–180; (xv) 180–200; (xvi) 200–250; (xvii) 250–300; (xviii) 300–350; (xix) 350–400; (xx) 400–450; (xxi) 450–500; (xxii) 500–600; (xxiii) 600–700; (xxiv) 700–800; (xxv) 800–900; (xxvi) 900–1000; (xxvii) 1000–2000; (xxviii) 2000–3000; (xxix) 3000–4000; (xxx) 4000–5000; and (xxxi) >5000.

39. A method as claimed in claim 31, wherein when said discharge device is in said first mode a first current or a first voltage is applied to said discharge device.

40. A method as claimed in claim 39, wherein said first current is selected from the group consisting of: (i) <0.1 μA; (ii) 0.1–0.2 μA; (iii) 0.2–0.3 μA; (iv) 0.3–0.4 μA; (v) 0.4–0.5 μA; (vi) 0.5–0.6 μA; (vii) 0.6–0.7 μA; (viii) 0.7–0.8 μA; (ix) 0.8–0.9 μA; (x) 0.9–1.0 μA; and (xi) >1 μA.

41. A method as claimed in claim 39, wherein said first voltage is selected from the group consisting of: (i) <1 kV; (ii) 1–2 kV; (iii) 2–3 kV; (iv) 3–4 kV; (v) 4–5 kV; (vi) 5–6 kV; (vii) 6–7 kV; (viii) 7–8 kV; (ix) 8–9 kV; (x) 9–10 kV; and (xi) >10 kV.

42. A method as claimed in claim 31, wherein when said discharge device is in said second mode a second current or a second voltage is applied to said discharge device.

43. A method as claimed in claim 42, wherein said second current is selected from the group consisting of: (i) <0.1 μA; (ii) 0.1–0.2 μA; (iii) 0.2–0.3 μA; (iv) 0.3–0.4 μA; (v) 0.4–0.5 μA; (vi) 0.5–0.6 μA; (vii) 0.6–0.7 μA; (viii) 0.7–0.8 μA; (ix) 0.8–0.9 μA; (x) 0.9–1.0 μA; and (xi) >1 μA.

44. A method as claimed in claim 42, wherein said second voltage is selected from the group consisting of: (i) <1 kV; (ii) 1–2 kV; (iii) 2–3 kV; (iv) 3–4 kV; (v) 4–5 kV; (vi) 5–6 kV; (vii) 6–7 kV; (viii) 7–8 kV; (ix) 8–9 kV; (x) 9–10 kV; and (xi) >10 kV.

45. A method as claimed in claim 31, further comprising providing an interscan delay between or whilst switching said discharge device from said first mode to said second mode during which time mass analysed data is either substantially not obtained or is not substantially used to provide at least one final mass spectrum.

46. A method as claimed in claim 45, wherein said interscan delay is selected from the group consisting of: (i) <1 ms; (ii) 1–10 ms; (iii) 10–20 ms; (iv) 20–30 ms; (v) 30–40 ms; (vi) 40–50 ms; (vii) 50–60 ms; (viii) 60–70 ms; (ix) 70–80 ms; (x) 80–90 ms; (xi) 90–100 ms; (xii) 100–150 ms; (xiii) 150–200 ms; (xiv) 200–250 ms; (xv) 250–300 ms; (xvi) 300–350 ms; (xvii) 350–400 ms; (xviii) 400–450 ms; (xix) 450–500 ms; (xx) 500–600 ms; (xxi) 600–700 ms; (xxii) 700–800 ms; (xxiii) 800–900 ms; (xxiv) 900–1000 ms; (xxv) 1–2 s; (xxvi) 2–3 s; (xxvii) 3–4 s; (xxviii) 4–5 s; (xxix) 5–6 s; (xxx) 6–7 s; (xxxi) 7–8 s; (xxxii) 8–9 s; (xxxiii) 9–10 s; and (xxxiv) >10 s.

47. A method as claimed in claim 31, further comprising providing a spray device for spraying a sample and causing said sample to form droplets.

48. A method as claimed in claim 47, further comprising arranging for said droplets to impinge upon a heated tube.

49. A method as claimed in claim 48, further comprising providing a housing at least partially enclosing said discharge device, wherein said heated tube discharges analyte molecules and/or analyte ions into said housing.

50. A method as claimed in claim 49, wherein said housing further comprises a gas exit port.

51. A method as claimed in claim 49, wherein said heated tube is received within or is substantially integral with said housing.

52. A method as claimed in claim 47, further comprising supplying a nebulising gas to nebulise said droplets.

53. A method as claimed in claim 31, further comprising providing a mass spectrometer.

54. A method as claimed in claim 53, wherein said mass spectrometer further comprises an ion sampling orifice.

55. A method as claimed in claim 54, further comprising the step of substantially shielding ions in the vicinity of said ion sampling orifice from an electric field generated by said discharge device.

56. A method as claimed in claim 54, further comprising the step of substantially shielding ions in the vicinity of said ion sampling orifice from an electric field generated by said discharge device by providing a housing surrounding at least part of said discharge device.

57. A method as claimed in claim 54, further comprising providing at least one electrode arranged opposite said ion sampling orifice so as to deflect, direct or repel at least some ions towards said ion sampling orifice.

58. A method as claimed in claim 31, further comprising coupling said ion source to a gas chromatograph.

59. A method as claimed in claim 31, further comprising coupling said ion source to a liquid chromatograph.

60. A method as claimed in claim 31, further comprising providing a mass analyser selected from the group consisting of: (i) a Time of Flight mass analyser; (ii) a quadrupole mass analyser; (iii) a Penning mass analyser; (iv) a Fourier Transform Ion Cyclotron Resonance ("FTICR") mass analyser; (v) a 2D or linear quadrupole ion trap; (vi) a Paul or 3D quadrupole ion trap; and (vii) a magnetic sector mass analyser.

* * * * *